US008566999B1

(12) United States Patent
Casey

(10) Patent No.: US 8,566,999 B1
(45) Date of Patent: Oct. 29, 2013

(54) EXTENSION FOR PAINT BRUSH HANDLE

(76) Inventor: Gordon C. Casey, Tulsa, OK (US)

( * ) Notice: Subject to any disclaimer, the term of this patent is extended or adjusted under 35 U.S.C. 154(b) by 302 days.

(21) Appl. No.: 12/904,669

(22) Filed: Oct. 14, 2010

Related U.S. Application Data

(60) Provisional application No. 61/259,320, filed on Nov. 9, 2009.

(51) Int. Cl.
*A46B 5/02* (2006.01)

(52) U.S. Cl.
USPC ..... 15/146

(58) Field of Classification Search
USPC ..... 15/146, 145, 143.1, 144.1, 144.2, 15/144.3, 144.4; 16/427
See application file for complete search history.

(56) References Cited

U.S. PATENT DOCUMENTS

| | | | | |
|---|---|---|---|---|
| 47,927 | A * | 5/1865 | Burtnett et al. | 403/68 |
| 579,519 | A | 3/1897 | Loeber et al. | |
| D26,974 | S | 4/1897 | MacKenzie | |
| 590,751 | A | 9/1897 | Clarke et al. | |
| 936,150 | A | 10/1909 | Nelson | |
| 1,599,273 | A | 9/1926 | Benkosky et al. | |
| 2,469,050 | A | 5/1949 | Mygas | |
| 2,792,581 | A | 5/1957 | Woyton | |
| 3,319,280 | A | 5/1967 | Trachsler | |
| 3,336,617 | A | 8/1967 | Bosko et al. | |
| 3,357,035 | A | 12/1967 | Ficke | |
| 3,413,043 | A | 11/1968 | Bertolina | |
| 3,737,187 | A | 6/1973 | Pryor | |
| 3,894,807 | A | 7/1975 | Betz, III | |
| 3,984,892 | A | 10/1976 | Kyriakou | |
| 3,994,037 | A | 11/1976 | Sims | |
| 4,157,598 | A | 6/1979 | Talent et al. | |
| D263,677 | S | 4/1982 | Clark | |
| 4,525,889 | A * | 7/1985 | Dunau | 15/146 |
| 4,715,080 | A | 12/1987 | Rydzicki | |
| D299,693 | S | 2/1989 | Wick | |
| 4,926,522 | A | 5/1990 | Wang | |
| 5,255,405 | A | 10/1993 | Samuelsson et al. | |
| D396,755 | S | 8/1998 | Lennox | |
| D445,259 | S | 7/2001 | Axelsson | |
| D456,147 | S | 4/2002 | Anderson | |
| 6,473,929 | B1 * | 11/2002 | Learned, III | 15/146 |
| 6,546,596 | B2 | 4/2003 | Grote et al. | |
| D556,458 | S | 12/2007 | Lanz | |
| 2008/0142648 | A1 | 6/2008 | Rabi et al. | |

FOREIGN PATENT DOCUMENTS

| | | |
|---|---|---|
| GB | 2374799 | 10/2002 |

* cited by examiner

*Primary Examiner* — Robert Scruggs
(74) *Attorney, Agent, or Firm* — Gable Gotwals

(57) ABSTRACT

A paint brush holder comprising an elongated cylindrical body having an open forward end portion and a coaxial reduced internal diameter rearward end portion, the tubular body forward end portion being dimensioned to slidably receive the paint brush handle and the tubular body forward end portion having an elongated narrow width slot therein extending from the cylindrical body open forward end to adjacent the reduced internal diameter rearward end portion; a threaded bolt extending perpendicularly from the paint brush handle and exterior of the cylindrical body through the elongated slot; and a nut threadably received on the bolt exteriorally of the cylindrical body whereby the paint brush handle may be lockably adjusted relative to the cylindrical body to thereby adjust the position of the paint brush bristles relative to the cylindrical body forward end.

3 Claims, 3 Drawing Sheets

EXTENSION FOR PAINT BRUSH HANDLE

CROSS-REFERENCE TO RELATED APPLICATION

This application claims priority to, and the benefit of, U.S. Provisional Pat. App. No. 61/259,320, filed Nov. 9, 2009.

BACKGROUND OF THE INVENTION

Paint is typically applied to walls, floors, ceilings and so forth utilizing a paint brush which has a handle long enough for being grasp by one hand of the user. The present invention pertains to the provision of a paint brush handle holder and extension which is long enough to be grasp by both hands of the user if necessary and to substantially increase the reach of the user so that many areas of a room can be painted without requiring a ladder.

BRIEF SUMMARY OF THE INVENTION

A basic object of the present invention is to permit the user to employ both hands for manipulation of a paint brush. In addition to facilitate an accurate placement of a paint brush by the use of both hands the invention herein allows a painter to reach surfaces of a height that would ordinarily require the use of a ladder, bench or so forth.

Further, the invention herein provides for multiple arrangements for varying the relationship between a typical paint brush and an extension handle so that various angular surfaces can more easily be engaged by the paintbrush.

BRIEF DESCRIPTION OF THE DRAWINGS

Preferred embodiments of the invention will now be described in further detail. Other features, aspects, and advantages of the present invention will become better understood with regard to the following detailed description and accompanying drawings (which are not to scale) where.

DETAILED DESCRIPTION OF THE PREFERRED EMBODIMENT(S)

It is to be understood that this invention is not limited in its application to the details of construction and arrangement of parts illustrated in the accompanying drawings. The invention is capable of other embodiments and of being practiced or carried out in a variety of ways. The phraseology and terminology employed herein are for the purpose of description and not of limitation.

Elements shown by the drawings are identified by the following numbers:

| | |
|---|---|
| 10 | Paint brush holder |
| 12 | First end |
| 14 | Cylindrical opening |
| 16 | Second end |
| 18 | Elongated slot |
| 20 | Inner surface |
| 22 | Smaller inner surface |
| 24 | Threaded opening |
| 26 | Thumb screw |
| 28 | Outer end portion |
| 30 | Extension pole |
| 32 | Main portion of the pole |
| 34 | First end |
| 36 | Cap |
| 38 | Second end |
| 40 | Coupling member |
| 42 | External threads |
| 44 | Paint brush |
| 46 | Paint brush bristles |
| 48 | Paint brush handle |
| 50 | Inner end of the paint brush handle |
| 52 | Bolt |
| 54 | Wing nut |

Figure 1:
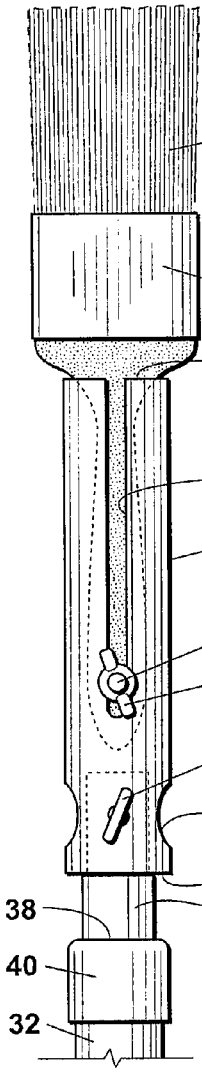
FIG. 1 is a plan view of a paint brush holder of this invention shown with a paint brush handle affixed thereto and one end of an extension pole secured to the paint brush holder.
Figure 2:
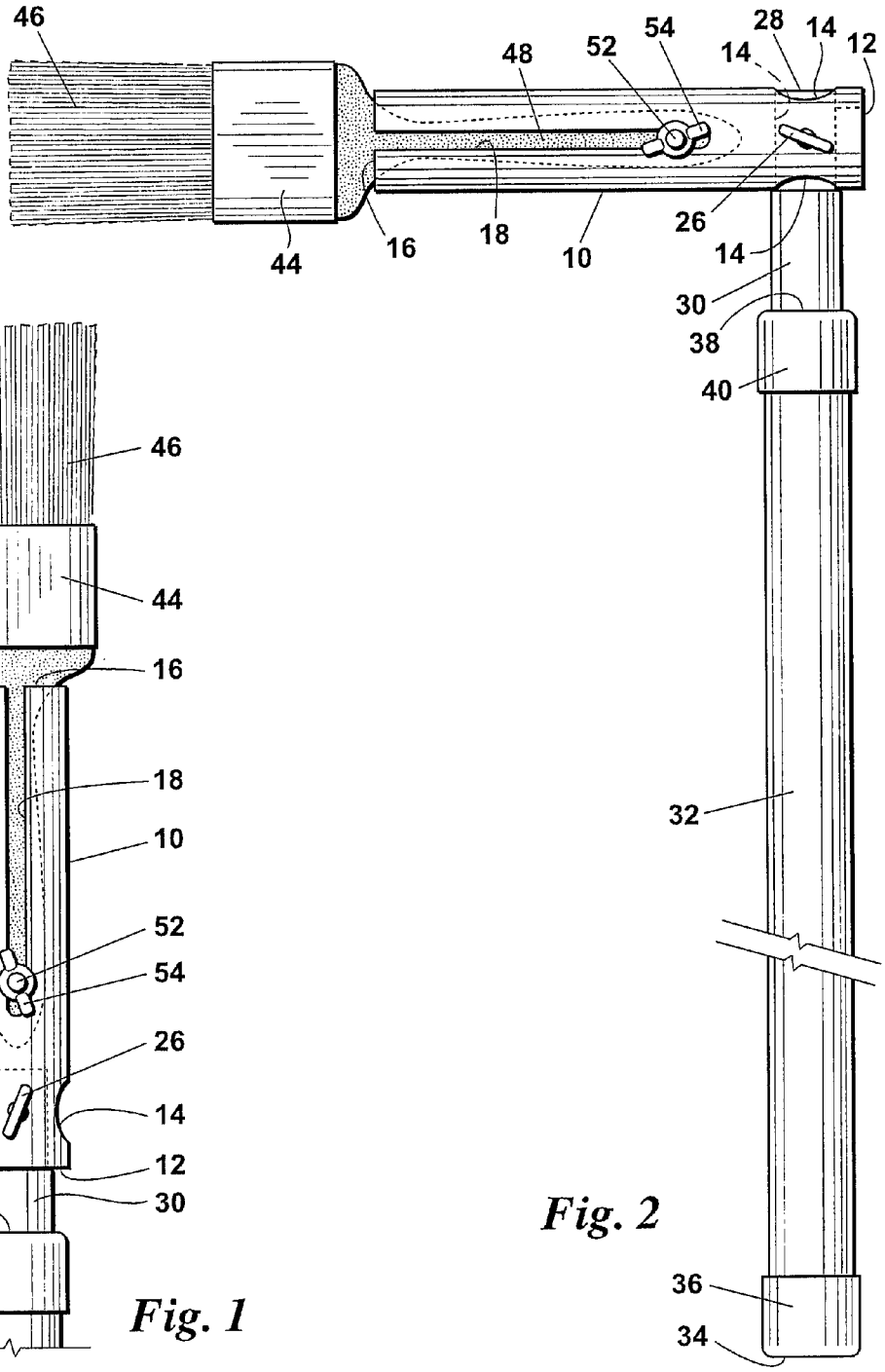
FIG. 2 is a view of the paint brush holder with a paint brush received therein and showing one end of an extension pole affixed to the holder in a different arrangement.

Referring first to FIGS. 1 and 2, the paint brush holder 10 of this invention is shown as used in two positions. The paint brush holder 10 is a generally tubular member having, adjacent a first end 12 thereof, a cylindrical opening 14 therethrough. Extending from the second end 16 of the paint brush holder 10 is a straight elongated slot 18.

Figure 3:
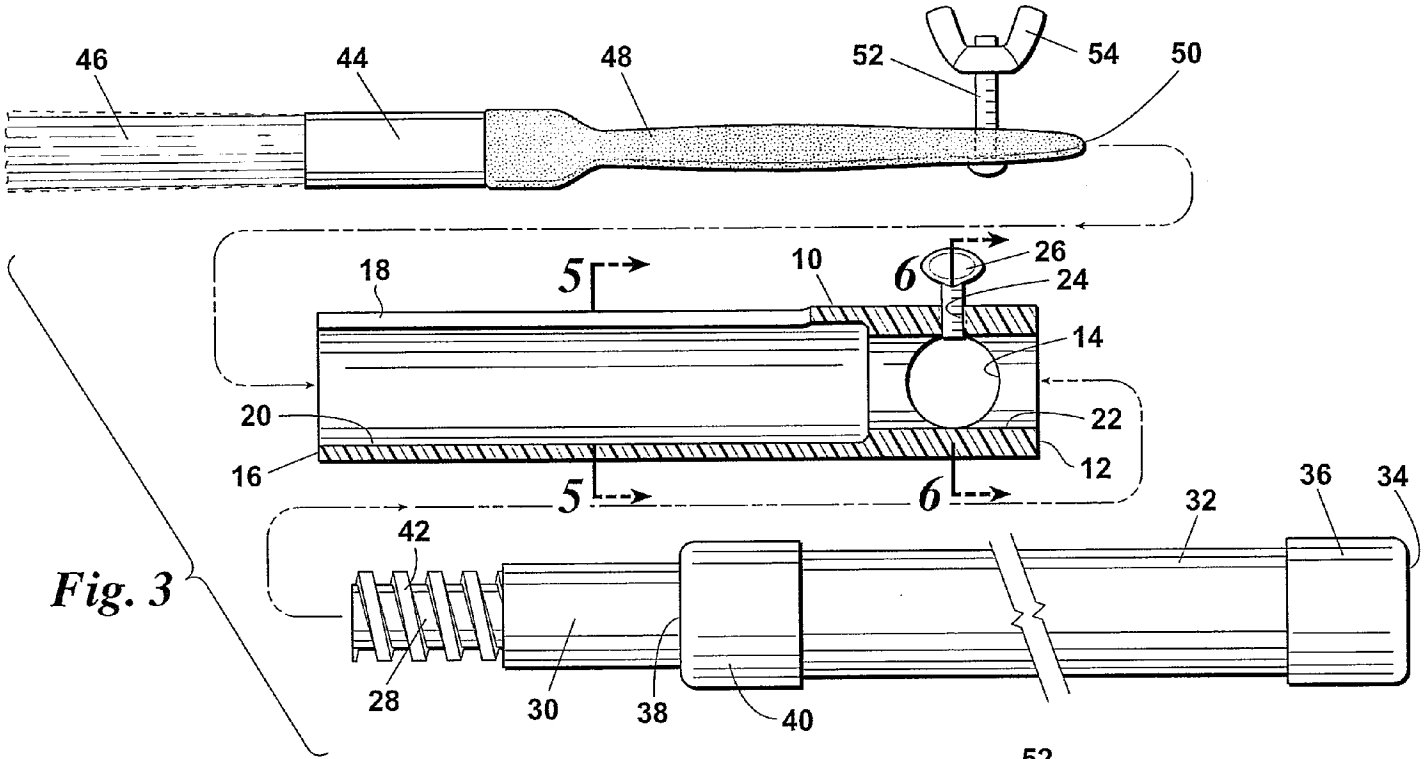
FIG. 3 is a cross-sectional view of the paint brush holder of the invention showing a paint brush handle telescopically extending therefrom and showing a fragmentary end of an extension pole that is receivable in the opposite end of the paint brush holder.
Figure 4:
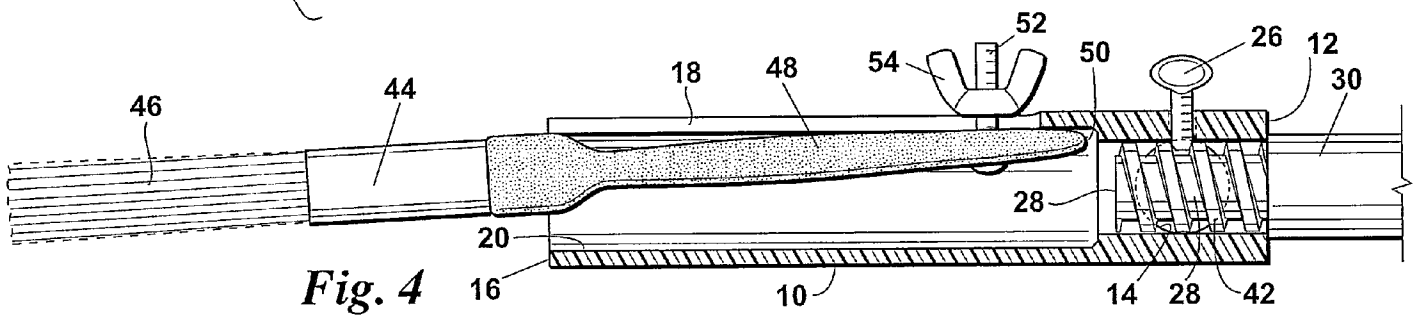
FIG. 4 shows the basic components illustrated in FIG. 3 as assembled together.
Figure 7:
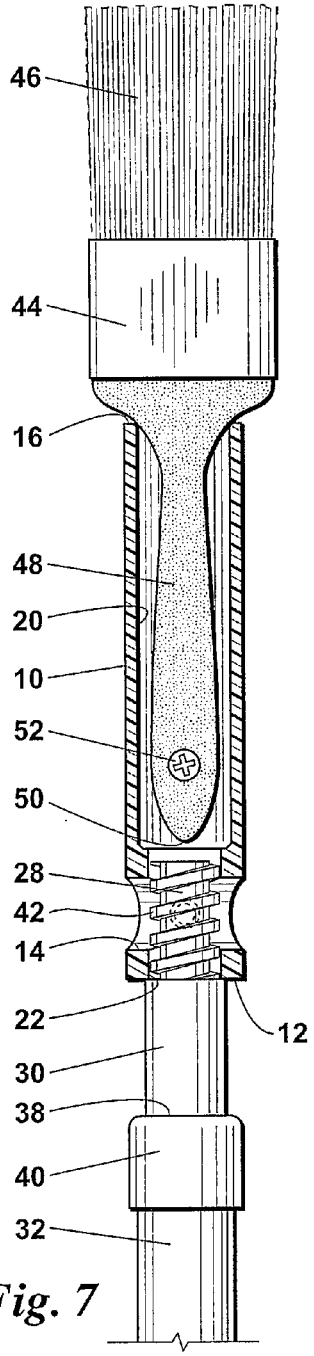
FIG. 7 shows the paint brush holder in cross-section as affixed to one end of an extension pole and a paint brush handle received in the opposite end.
Figure 8:
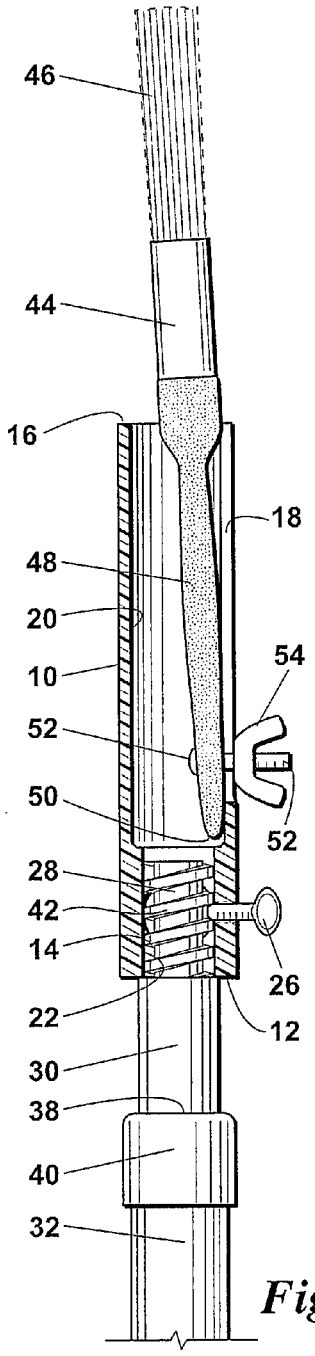
FIG. 8 is a view rotated 90° relative to FIG. 7.
Figure 5:
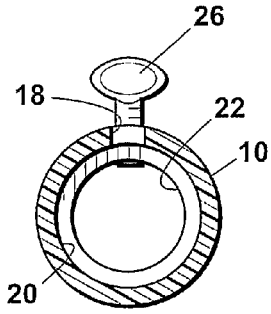
FIG. 5 is a cross-sectional view of the paint brush holder as taken along the line 5-5 of FIG. 3.
Figure 6:
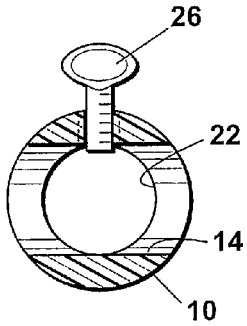
FIG. 6 is a cross-sectional view of the paint brush holder and a thumb screw received therein as taken along the line 6-6 of FIG. 3.

The cross-sectional view of FIG. 3 shows the paint brush holder 10 to be a tubular member having a cylindrical inner surface 20 with a co-axial smaller internal diameter inner surface portion 22 adjacent first end 12. The cylindrical opening 14 in the paint brush holder adjacent first end 12 is shown extending through the interior surface 22.

Formed in holder 10 adjacent the first end 12 and intersecting the cylindrical opening 14 is a threaded opening 24 that receives the threaded end of a thumb screw 26. The function of thumb screw 26 is to engage the outer end portion 28 of an extension pole 30.

Extension pole 30 as illustrated has two basic portions, that is, a main portion 32 configured to be gripped by a user and extension pole 30 that is telescopically received within main portion 32. The main pole portion 32 has a first end 34 that is shown with a cap 36. The second end 38 of main pole portion 32 telescopically receives the pole extension portion 30. Threadably received on the second end of main pole portion 32 is a coupling member 40 by which the extension pole portion 30 is telescopically locked with reference to the main pole portion 32. By threadably tightening coupling member 40 the extension pole portion 30 is longitudinally secured relative to the main pole portion 32.

The outer end portion 28 of the extension pole 30 is shown in FIGS. 3, 4, 7 and 8 as having external threads 42. This is optional as the threads 42 are not required for use with the paint brush holder 10 as illustrated and described herein however, the extension pole with the external threads 42 are commonly commercially available and can be conveniently used with the paint brush holder 10 of this invention.

FIGS. 1, 2, 4, 7 and 8 show the use of a paint brush 44 in conjunction with paint brush holder 10. Paint brush 44 is of the usual construction of a hand held paint brush and includes a body portion 44 having extended therefrom paint brush bristles 46 that are commonly made of horse hair or some similar material. Extending from the opposite end from paint brush bristles 44 is a paint brush handle 48 that is customarily made of wood or plastic and is configured to be manually engaged by one hand for applying paint from the paint brush bristles 46 to a surface being painted. Paint brush handle 48 has an inner end 50 and adjacent thereto is a bolt 52 having a wing nut 54 threadably received thereon.

Bolt 52 is received in the elongated slot 18 of paint brush holder 10. In this way the extension of the paint brush handle 48 with respect to the paint brush holder is longitudinally adjustable. FIGS. 1, 2, 7 and 8 shows the paint brush handle 48 withdrawn substantially its full length within the paint brush holder 10. If required, wing nut 54 can be loosened and handle 48 extended relative to holder 10. With paint brush 48 extended outwardly relative to holder 10 a user can, if he or she desires, conveniently use both of his or her hands to manipulate paint brush 44 so that holder 10 is not required to be attached to extension pole 30/32.

FIGS. 1, 4, 7 and 8 show paint brush holder 10 secured co-axially to the outer end of extension pole 30/32 whereas FIG. 2 shows pole 30/32 secured at a 90° angle relative to the longitudinal length of paint brush holder 10. This illustrates the variety of ways in which paint brush holder 10 can be used to facilitate reaching portions of a surface being painted that would otherwise be difficult for the user. Further, it should be clear that paint brush holder 10 can be used with or without extension pole 30/32 thereby emphasizing the variety of ways in which paint brush holder 10 of this invention may be employed to augment the use of paint brush 44.

Various modifications will occur to those skilled in the art and the proportions and disposition of component elements of the paint brush holder as illustrated and described herein as well as in the specific form taken by the respective parts of the paint brush holder. No limitation is intended by the phraseology of the foregoing description or illustrations in the accompanying drawings.

What is claimed is:

1. For use with a paint brush having at one end a handle configured to be grasped by the hand of a painter and at an opposite end paint brush bristles configured to receive liquid paint thereon by which the paint may be spread upon a surface to be painted, a paint brush holder comprising:

an elongated cylindrical body having an open forward end portion and a coaxial reduced internal diameter rearward end portion, said cylindrical body forward end portion being dimensioned to slidably receive said paint brush handle and said cylindrical body forward end portion having an elongated narrow width elongated slot therein extending from said cylindrical body open forward end to adjacent said reduced internal diameter rearward end portion, said reduced internal diameter rearward end portion having an opening that is perpendicular to a longitudinal axis of said cylindrical body and is dimensioned to slidably receive an extension pole, said reduced internal diameter rearward end portion also having opposite openings that are parallel to the longitudinal axis of said cylindrical body and create a passageway that extends through the rearward end portion, said passageway being dimensioned to slidably receive an extension pole;

a threaded bolt extending perpendicularly from said paint brush handle and exterior of said cylindrical body through said elongated slot;

a nut threadably received on said bolt exteriorly of said cylindrical body whereby said paint brush handle may be lockably adjusted relative to said cylindrical body to thereby adjust the position of said paint brush bristles relative to said cylindrical body forward end; and a thumb screw to lock the extension pole in a perpendicular or a parallel position within said cylindrical body.

2. A paint brush holder according to claim 1 including an extension pole having a forward end portion that is dimensioned to be lockably and coaxially received in said cylindrical body reduced internal diameter rearward end portion.

3. A paint brush holder according to claim 2 wherein said elongated cylindrical body has a perpendicular opening in said reduced internal diameter rearward end portion that is axially perpendicular to a tubular axis of said cylindrical body, said forward end portion of said extension pole being receivable and lockable in said perpendicular opening whereby a brush handle received in said cylindrical body is supported perpendicular to said extension pole.

* * * * *